US005919066A

United States Patent [19]

Harting et al.

[11] Patent Number: 5,919,066

[45] Date of Patent: Jul. 6, 1999

[54] CONNECTOR FOR HIGH CURRENTS

[75] Inventors: Dietmar Harting, Espelkamp; Klaus Olejarz, Bad Oeynhausen, both of Germany

[73] Assignee: Harting KGaA, Espelkamp, Germany

[21] Appl. No.: 08/833,731

[22] Filed: Apr. 9, 1997

[30] Foreign Application Priority Data

Apr. 12, 1996 [DE] Germany ..... 196 14 489

[51] Int. Cl.[6] ..... H01R 13/05

[52] U.S. Cl. ..... 439/825; 439/851

[58] Field of Search ..... 439/825, 826, 439/827, 843, 856, 851, 857

[56] References Cited

U.S. PATENT DOCUMENTS

| | | | |
|---|---|---|---|
| 1,064,920 | 6/1913 | Lovejoy | 439/786 |
| 2,125,816 | 8/1938 | Reynolds . | |
| 3,963,322 | 6/1976 | Gryctko | 439/814 |
| 4,114,262 | 9/1978 | Franck | 439/877 |
| 4,906,212 | 3/1990 | Mixon, Jr. | 439/857 |
| 5,135,403 | 8/1992 | Rinaldi | 439/857 |
| 5,358,433 | 10/1994 | Dechanteloup et al. | 439/843 |
| 5,397,253 | 3/1995 | Fries | 439/825 |

FOREIGN PATENT DOCUMENTS

| | | |
|---|---|---|
| 718.096 | 1/1932 | France . |
| AS 1 121 681 | 1/1962 | Germany . |
| 296 06 881 U | 8/1996 | Germany . |
| 138 117 | 4/1930 | Switzerland . |
| 448 204 | 3/1968 | Switzerland . |

*Primary Examiner*—Steven L. Stephan
*Assistant Examiner*—Brian J. Biggi
*Attorney, Agent, or Firm*—Dorn, McEachran,Jambor & Keating

[57] ABSTRACT

For a connector for high currents, in order to reduce the volume resistance it is proposed to provide the front end of the contact pin with spring tongues and to form the rear end of the contact socket as a rigid, essentially inflexible socket. Front spring tongues of the contact socket act on the solid part of the contact pin, and the spring tongues of the contact pin act against the wall of the rear end of the contact socket.

3 Claims, 2 Drawing Sheets

CONNECTOR FOR HIGH CURRENTS

The invention relates to a connector for high currents, comprising a pin-shaped contact pin and a sleeve-shaped contact socket provided with spring tongues.

With connectors of this kind it is necessary for the volume resistance between the contact pin and the contact socket to be as low as possible, to keep the heating of the contact point as low as possible when current is flowing.

It is generally known to design the contact pin of such a connector as a solid pin and to provide the contact socket with slots for forming spring tongues, so as to achieve a large number of contact points and to keep the volume resistance low thereby.

The object of the invention is to design a connector of the above-mentioned kind in such a way that as low as possible a volume resistance is achieved when the connector is joined together.

This object is achieved in that the substantially solid insertion end of the contact pin has a bore at the front end, and that slots for forming spring tongues are provided in the region of the bore, and that the sleeve-shaped contact socket has slots for the formation of spring tongues only at the front end, and that the rear region of the contact socket has an un-slotted narrowing.

Advantageous embodiments of the invention are quoted in claims 2 and 3.

The advantages achieved with the invention comprise in particular the fact that the volume resistance is reduced by increasing the number of contact points when the connector is joined together, wherein the heating of the connector which optionally still occurs can be satisfactorily dissipated by means of the semi-open construction (slots).

An embodiment of the invention is shown in the drawings and will be described in greater detail below. The illustrations are as follows.

Figure 1:
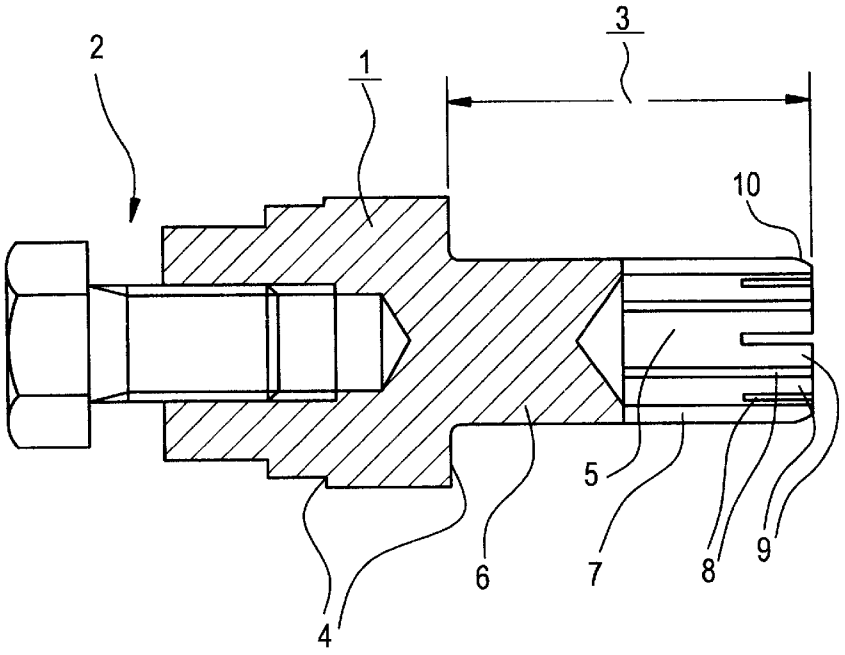
FIG. 1 shows a view of a contact pin.

The contact pin 1 shown in FIG. 1 is preferably produced as a turned part from solid material and has a conductor connection end 2 and an insertion end 3.

Between these two outer ends, the contact pin is provided with steps 4 for mounting in a carrier body and/or housing not shown in greater detail here. A centric bore 5, which reaches approximately to the middle of the insertion end, is moulded into the insertion end 3 from the front so that the insertion end has a solid part-piece 6 and a sleeve-shaped part-piece 7. The sleeve-shaped part-piece is provided with slots 8 by means of which spring tongues 9 are formed. A conical lead-in bevel 10 is provided at the front end to facilitate the insertion of the contact pin into a contact socket.

Figure 2:
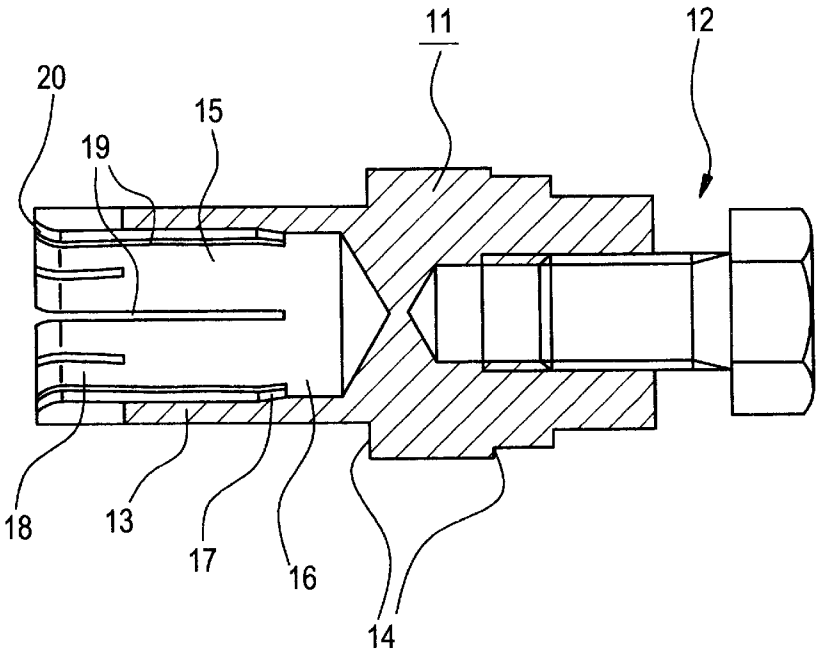
FIG. 2 shows a view of a contact socket.

The contact socket 11 shown in FIG. 2 is also preferably produced as a turned part from solid material and has a conductor connection end 12 and a sleeve-shaped insertion end 13. Between the two outer ends, the contact socket is provided with steps 14 for mounting in a carrier body and/or housing not shown in greater detail here. The sleeve-shaped insertion end is produced by a centric bore 15. In its end region this bore has a smaller diameter than at the beginning, so that the rear region of the insertion end has a narrowing 16. The transition between the front and rear region is provided with a conical bevel 17. To form spring-loaded contact tongues 18, the outer sleeve of the insertion end is provided with slots 19 which extend into the region of the bevel 17. The sleeve-shaped insertion end 13 of the contact socket thus has a front flexible region with spring tongues and a rear region that is inflexible and essentially rigid.

Figure 3:
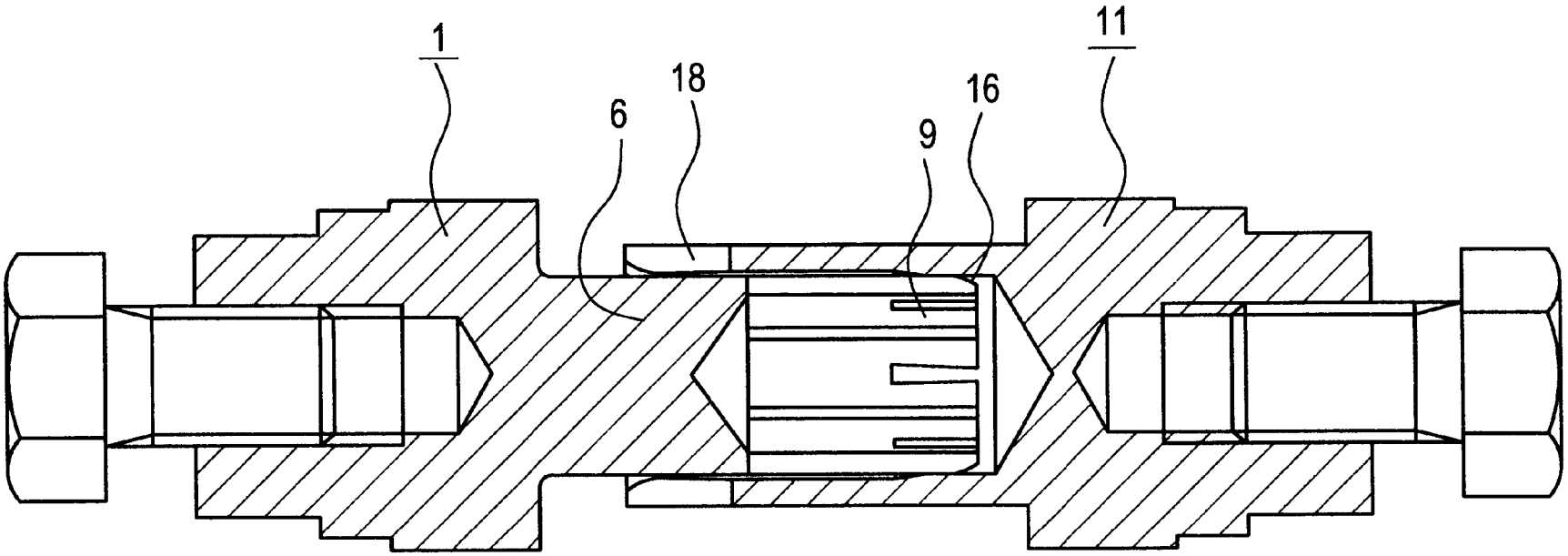
FIG. 3 shows the view of a connector when joined together.

The cooperation of the various regions of the contact pin 1 and the contact socket 11 is shown in FIG. 3, which shows a connector when joined together.

The front end of the contact pin 1 provided with spring tongues 9, i.e. its sleeve-shaped part-piece 7, is pushed in as far as the narrowing 16 of the contact socket 11. Corresponding dimensions of the diameter of the front end of the contact pin and the narrowing mean that the spring tongues 9 press in a spring-loaded manner against the wall of the narrowing, wherein as many contact points as correspond to the number of spring tongues are formed.

When the connector is joined together the front ends of the contact tongues 18 of the contact socket are located in the region of the solid part-piece 6 of the contact pin and act on them in a spring-loaded manner, wherein as many contact points as correspond to the number of contact tongues 18 are also formed. To increase the spring force provision can be made for the contact tongues 18 to be bent slightly inwards (pre-loaded) before insertion of a contact pin and for a lead-in bevel 20 to be provided for improved insertion of a contact pin.

We claim:

1. A high current connector including a contact pin and a contact socket sleeve, the contact pin (1) having a front end bore (5) extending partially axially into said pin, said pin having a solid portion (6) directly adjacent said bore, a plurality of axial slots (8) in the area of said front end bore, said slots forming a plurality of axially extending spring tongues (9), the contact socket sleeve (11) having an inner bore defining a first portion (15) and a second portion (16), said first portion having axial slots (19) defining spring tongues (18), said second portion being unslotted and having an inner diameter less than the inner diameter of said first portion, when the contact pin is inserted in the socket sleeve, the axial spring tongues (9) extend into and are in contact with the unslotted second portion (16) of the socket sleeve, and the spring tongues (18) of the socket first portion are in contact with the solid portion (6) of the contact pin.

2. The connector of claim 1 wherein the spring tongues (18) of the contact socket (11) are inwardly preloaded.

3. The connector of claim 1 wherein there is a lead-in bevel (17) between the first portion and the second portion of said contact circuit (11).

* * * * *